United States Patent [19]

Bottoms

[11] Patent Number: 4,624,015

[45] Date of Patent: Nov. 25, 1986

[54] KARATE AND KICK BOXING PROTECTIVE BOOT

[76] Inventor: James D. Bottoms, 15540 Vicennes, Sepulveda, Calif. 91343

[21] Appl. No.: 644,458

[22] Filed: Aug. 27, 1984

[51] Int. Cl.[4] ..... A41D 13/06; A43B 5/00

[52] U.S. Cl. ..... 2/22; 36/72 R; 36/96

[58] Field of Search ..... 36/113, 7.1 R, 72 R, 36/72 A, 72 B, 1.5, 2 R, 96, 97, 102, 114, 106, 71, 4, 58.6, 58.5; 2/22, 16, 414, DIG. 4

[56] References Cited

U.S. PATENT DOCUMENTS

| | | | |
|---|---|---|---|
| 1,620,935 | 3/1927 | Arnsberg | 36/72 B |
| 2,640,989 | 6/1953 | Woodward | 2/22 |
| 2,721,331 | 10/1955 | Scheitlin | 2/237 |
| 3,074,405 | 1/1963 | Duensing | 2/22 X |
| 3,667,140 | 6/1972 | Hunderford | 36/4 |
| 4,001,953 | 1/1977 | Fugere et al. | 2/22 X |
| 4,008,531 | 2/1977 | Schonbrun et al. | 36/106 |
| 4,103,437 | 8/1978 | Dillard | 36/106 X |
| 4,120,103 | 10/1978 | Colby | 36/97 |
| 4,190,971 | 3/1980 | Wren, Jr. et al. | 36/114 X |
| 4,344,189 | 8/1982 | Futere et al. | 2/16 |
| 4,361,912 | 12/1982 | Arthur | 2/22 X |
| 4,361,970 | 12/1982 | Wren, Jr. et al. | 36/114 X |
| 4,366,629 | 1/1983 | Scherz | 36/4 |
| 4,382,301 | 5/1983 | Hightower, Jr. | 2/22 |
| 4,489,509 | 12/1984 | Libit | 36/7.1 R |
| 4,509,213 | 4/1985 | Harvey | 2/22 |
| 4,516,336 | 5/1985 | Nissenbaum | 36/7.1 R |

*Primary Examiner*—Werner H. Schroeder
*Assistant Examiner*—Andrew M. Falik
*Attorney, Agent, or Firm*—Freilich, Hornbaker, Rosen & Fernandez

[57] ABSTRACT

A protective fighting boot provides for a neat appearance and for the fitting of feet of a range of sizes. A leg protector includes a thick sheet of resilient foam which covers the ankle of the wearer, and which is protected on the outside by a cloth which is corrugated along the ankle to enable elongation of the cloth when flexing at the ankle. A heel protector is held to the leg protector by straps which are attachable at different locations therealong to the leg protector to enable the same size of leg and heel protectors to be used with feet of different lengths.

6 Claims, 7 Drawing Figures

FIG. 1
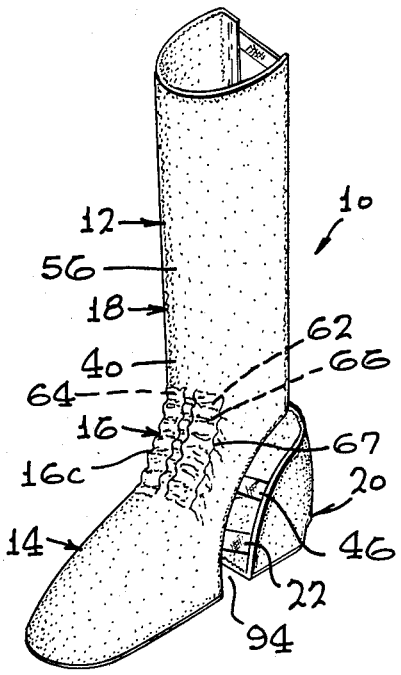
FIG. 2
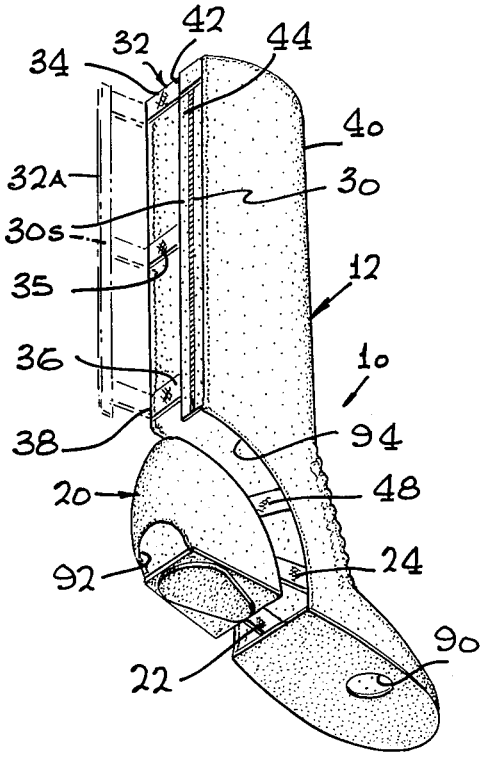
FIG. 3
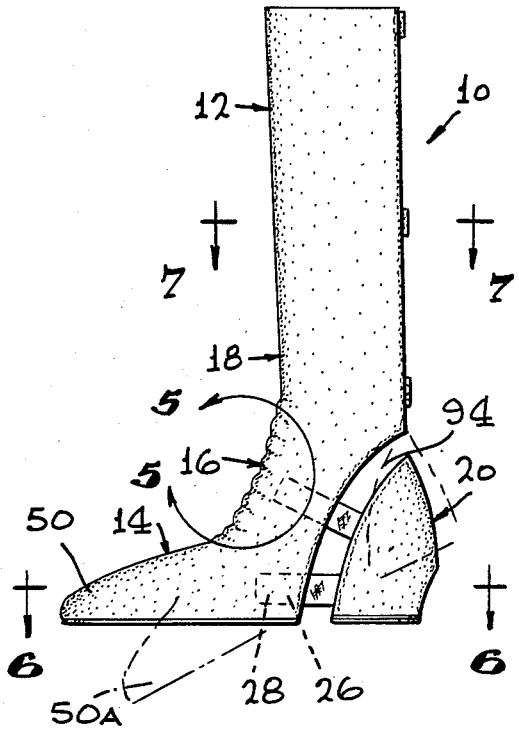
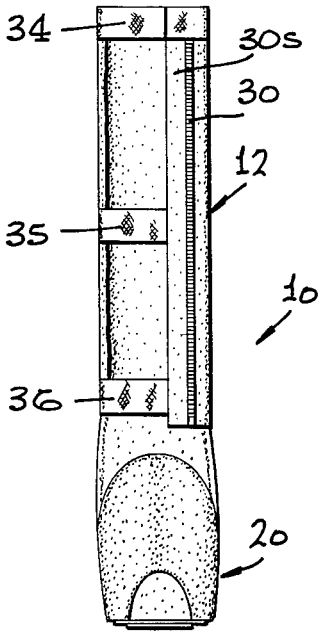
FIG. 4

FIG. 5
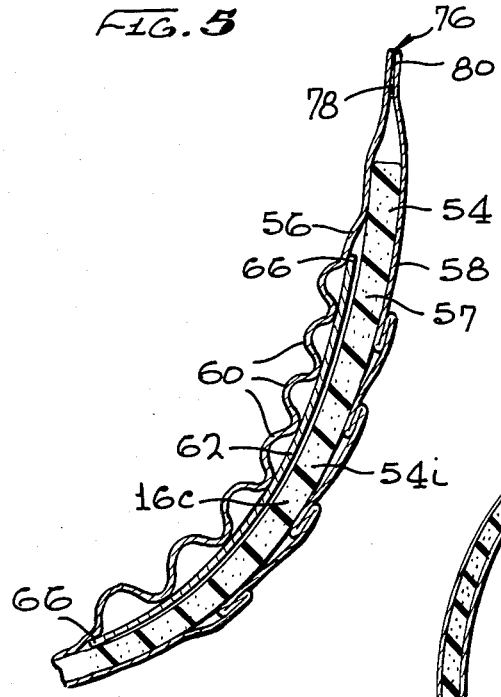
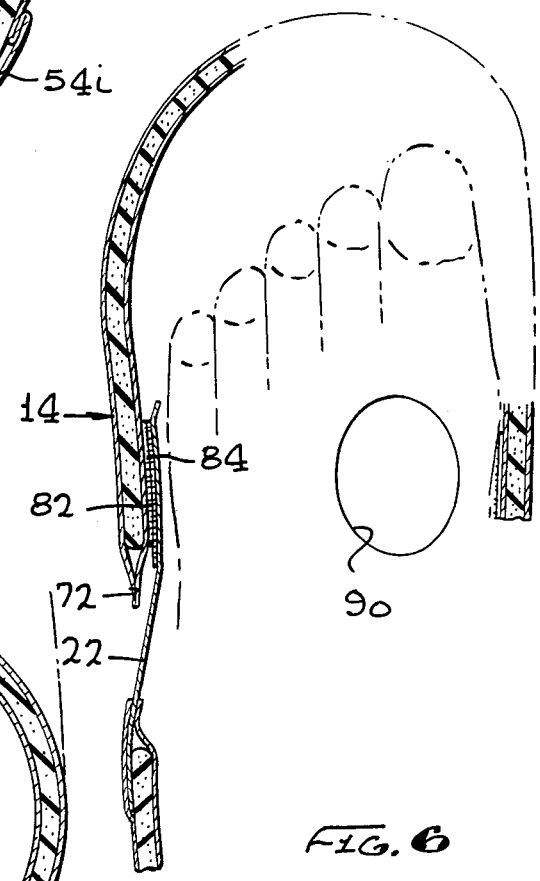
FIG. 6
FIG. 7
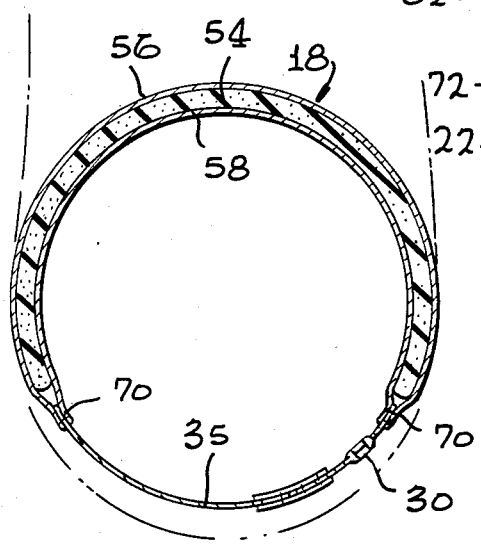

KARATE AND KICK BOXING PROTECTIVE BOOT

BACKGROUND OF THE INVENTION

Protective footwear used for practice fighting can include a thick sheet of foam. However, it is generally desirable to cover the foam with cloth to avoid damage to the foam. One problem is that it is difficult to use a cloth to protect the region of the instep of the foot which may be bent at a large angle, without using an elastic cloth that would resist bending of the foot.

It is desirable to construct protective boots so that they protect not only the leg and ankle of the wearer but also protect the front and back of his foot. If both the front and back are to be protected, it usually would require that a manufacturer make a number of different sizes of protective boots to fit wearers with different lengths of feet. A protective boot of the type which used thick sheets of elastic foam for protection, while providing protection for the foam in an attractive boot, and while also providing a boot arrangement that can fit person with a range of foot lengths, would be useful in the furnishing of protection for the practicing of certain types of fighting.

SUMMARY OF THE INVENTION

In accordance with one embodiment of the present invention, a protective fighting boot is provided, which is long lasting, neat in appearance, and fitable to persons with different lengths of feet. One boot includes a leg protector that protects the front of the foot, and which includes a thick sheet of resilient foam that extends through the instep of the foot from above to below it. The foam sheet is protected by a flexible cloth which is corrugated at the instep to permit flexing at the ankle of the wear. A separate heel protector is adjustably fastened to the leg protector, to permit their joining at a range of separations so as to accomodate feet of different lengths.

The novel features of the invention are set forth with particularity in the appended claims. The invention will be best understood from the following description when read in conjunction with the accompanying drawings.

BRIEF DESCRIPTION OF THE DRAWINGS

FIG. 1 is a top, front, and left side perspective view of a protective fighting boot constructed in accordance with the present invention.

FIG. 2 is a bottom, rear, and right side perspective view of the boot of FIG. 1.

FIG. 3 is a left side elevation view of the boot of FIG. 1.

FIG. 4 is a rear elevation view of the boot of FIG. 1.

FIG. 5 is a sectional view of the areas 5—5 of FIG. 3.

FIG. 6 is a partial sectional view taken on the line 6—6 of FIG. 3.

FIG. 7 is a partial sectional view taken on the line 7—7 of FIG. 3.

DESCRIPTION OF THE PREFERRED EMBODIMENT

FIGS. 1-3 illustrate a protective fighting boot 10 which can be worn by a person during the practicing of karate or kick boxing, to protect both the wearer of the boot and his opponent. The boot includes a leg protector 12 which has portions 14, 16, and 18 that respectively cover the lower front or shin of the foot, the instep, and the calf region of the wearer's foot. The boot also includes a heel protector 20 that largely covers the heel region of the foot to protect it. The heel protector encircles part of the heel of the wearer and part of the achillies tendon of the wearer. The heel protector 20 has a largely fixed concave shape for largely surrounding the heel of the wearer and is designed to be held to the bottom of the leg protector 12 by a pair of largely horizontally-extending straps 22, 24 that have Velcro pads 26 at their outer ends that can engage mating Velcro pads 28 on the leg protector. A buyer of the boot is expected to adjust the positions where the Velcro pads, or attachment location, 26, 28 are engaged, to fit the length of his feet.

A wearer can ready the fighting boot for placement on his foot by first unzipping a zipper 30 (FIG. 2) to open a rear bridge 32 to the position 32 A shown in FIG. 2. The bridge 32 includes three elastic straps 34–36 having inner ends 38 sewn to the left side of the front covering 40 of the boot. Each strap also has an outer end 42 sewn to a vertical strip 44 which carries one side of a zipper 30*s* at its end. The person also adjusts the positions at which the lower straps 22, 24 are attached to the leg protector. After a person has unzipped the bridge 32, he pivots the heel protector 20 out of the way, places his heel in the heel protector, and then wraps a pair of upper heel protector straps 46, 48 around his instep. The straps 46, 48 carry Velcro pads at their ends. The person places his foot within the front of the leg protector, pulls on the elastic straps 34–36 and zips the zipper 30 closed.

Many types of kicks require the wearer to bend his foot down at the ankle, so that the front of his foot 50 (FIG. 3) moves to the position 50A or even further. The boot is constructed to permit such pivoting at the ankle, while providing for thick padding to pad the instep 16 of the wearer and to protect the padding while maintaining a relatively neat appearance. As shown in FIG. 5, the boot includes a thick sheet 54 of resilient foam material such as resilient nylon foam. A pair of cloth layers 56, 58 cover the foam sheet 54, to prevent water from entering the foam and to also protect the foam against damage from rubbing directly against it.

A rayon cloth is suitable for the layers 56, 58 to provide a tough, smooth covering at relatively low cost. However, while the rayon cloth is flexible, it is not considerably elastic. In order to use the cloth layers 56, 58 to protect the instep portion 54*i* of the foam sheet, the cloths are corrugated along the instep of the boot. The outer cloth 56 is formed with numerous corrugations 60 along the outside of the instep, to allow for elongation when the foot of the wearer is pivoted down at the ankle.

If the corrugation 60 were not held down, they could bunch up into one or a few large corrugations, which would create an unsightly appearance. To avoid this, applicant uses a pair of elastic bands or strips 62, 64 (FIG. 1 and 5) that each extend between the top and bottom of the instep and which are each sewn to the corrugated outer cloth 56 along the instep. The sew lines are the locations shown in hidden lines at 66 in FIG. 1. The elastic on the inner face of the cloth layer 56, particularly the stitches 67 extending down from above to below the center 16*c* of the wearer's instep, keeps the corrugations from bulging out more than a small amount to provide a neat appearance, and yet the elastic strips can stretch and permit the corrugations to separate to accomodate lengthening of the instep when the foot is pivoted down. Thus the elastic bands or strips holds the position of the corrugations at substantially all foot pivoting positions. The resistance to stretching of the elastic strips is less than of a single broad sheet of elastic, and the roughness of the elastic is covered by the smooth cloth material sheet 56. The flexible but substantially non-elastic outer cloth 56 still lies on the outside of the leg protector to provide a tough smooth outer surface for the protector.

The thick resilient foam sheet 54 is trapped between the outer and inner cloth layers 56, 58, but can be removed from between them, for washing of the cloth without the necessity to wash the foam layer (which could become damaged from such washing). The two cloth layers 56, 58 are sewn together at seams 70, 72, and 74 (FIG. 2) along the upper, instep, and foot portions of the leg protector, but not at the top 76 of the leg protector. As shown in FIG. 5, the two cloths have Velcro pads 78, 80 at the top of the leg protector, that permit the cloths to be separated thereat. After separation of the tops of the cloth layers, the foam sheet 54 can be pulled out from between them.

As shown in FIG. 7, the upper portion 18 of the leg protector is held to the calf of the leg by both elastic straps such as 35 and by a zipper 30. The zipper 30 permits rapid removal and replacing of the fighting boot on the leg while the straps 35 keep the leggings tightly in place. If only the elastic straps 35 were used, it would be more difficult to put on and take off the leg protector unless the straps were loosened somewhat, which would increase the chance that they came off during practice fighting.

As mentioned earlier, a pair of lower heel protector straps 22, 24 serve to connect the lower end of the leg protector to the lower end of the heel protector, to keep both of them in place. FIG. 6 shows how Velcro pads 82, 84 on the outer side of the strap and on the inner side of the foot portion 14 of the leg protector can be fastened together at a variety of different locations to accomodate feet of a variety of lengths.

As shown in FIG. 2, a hole 90 is formed in the sole of the foot, at the location where the ball of the foot will be located, the particular boot being one made for the left foot. The opening 90 permits the actual ball of the wearer's foot to contact the floor on which he is standing, to provide better sense for when the wearer is slipping, and to allow the wearer to place considerable weight on the ball of his foot and have his foot directly contact the surface on which he is standing to provide a reliable friction or "grip" with the surface. The heel protector 20 is provided with a hole 92 in the back to provide circulation of air to reduce the buildup of heat. The gap 94 between the leg protector and heel protector, and the gaps between horizontal straps 34–36, all enhance air circulation to reduce heat buildup.

Thus, the invention provides a protective fighting boot which has a neat apperance, which protects the foam padding to provide a longer lifetime of use, and which enables the same boot to fit persons with different lengths of feet. A thick elastic sheet of padding is protected, at least at the front, by a substantially non-elastic though flexible cloth layer. The cloth layer is corrugated at the instep of the foot to permit elongation when the front of the wearer's foot is moved down during kicking. The corrugations are kept in position and of small size by elastic strips which are sewn to the corrugated cloth along the instep. The thick elastic foam sheet is trapped between an inner and outer cloth, which are sewn together except at the top of the leg protector where the cloths are joined by Velcro fasteners, so when the fasteners are detached the foam sheet can be removed and replaced. The boot includes a separate heel protector which can be joined to the leg protector by a pair of straps which are joinable at variable locations to permit the heel protector to fit persons with feet of different lengths.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A protective fighting boot which can be worn by a person in practicing karate and kick boxing, comprising:

a leg protector which has a lower portion that covers the top of the foot and an upper portion that covers the shin, said leg protector having means for holding itself to the leg of the wearer including a portion that almost completely surrounds the leg at a location above the ankle; and a substantially separate heel protector which has a rearward portion of largely fixed concave shape that surrounds the heel region of the wearer, said rearward portion having a pair of sides that lie on opposite sides of the wearer's heel, and being attached to said leg protector by a pair of straps tht extend between said opposite sides and locations substantially on the lower portion of said leg protector, the length of each of said straps between said heel protector and said leg protector locations being adjustable to enable attachment of the same heel protector to feet of different lengths.

2. A protective fighting boot which can be worn by a person in practicing karate and kick boxing, comprising:

a leg protector which includes a paded front shin portion that covers the shin of a wearer and extends most, but not all, of the way around the leg of the wearer to form first and second opposite sides lying on opposite sides of the calf of the wearer, and a lower portion that encircles the front of the foot of the wearer;

said protector including a plurality of vertically spaced horizontal elastically-stretchable straps that each have an inner end sewn to a first of said sides of said padded front portion and an outer end, a vertical strip which is joined to the outer ends of said straps, and a zipper having a pair of vertical zipper parts, one zipper part sewn to said vertical strip and a second zipper part sewn to the second side of the padded front portion, whereby to enable tight elastic gripping of the foot while enabling easy and fast putting on and taking off.

3. The fighting boot described in claim 5 including:

a heel protector which includes a padding that encircles at least part of the bottom of the heel portion and the achillies tendon portion of the wearer's foot, said heel protector including a pair of largely horizontally-extending straps with free outer ends and having means at their outer ends that attach to the lower portion of said leg protector at a plurality of horizontally spaced positions, whereby to enable fitting of persons with feet of different lengths.

4. The fighting boot described in claim 6 wherein:

said heel protector has a second pair of straps that can encircle the front ankle of the wearer and fasten to each other.

5. A protective fighting boot which can be worn by a person in practicing karate and kick boxing, comprising:

a sheet of resilient foam which extends in a smooth uncorrugated curve to cover the front of at least the lower part of the shin, the ankle, and the top of the foot, said sheet of foam havig an inside face facing the leg of the wearer and an opposite outside face;

a flexible cloth which covers the outside face of said sheet of foam, along the front of the lower shin part, ankle, and top of the foot of the wearer, said sheet of foam being more than twice as thick as said cloth, said cloth being corrugated along the ankle to cover the smooth uncorrugated sheet of foam; and an elastic band which is fastened to the inner face of said cloth, which is the face closest to the leg of the wearer, along lines that extend from above the below the center of the instep of the wearer whereby to hold the positions of the corrugations at substantially all foot pivoting positions.

6. A protective fighting boot which can be worn by a person in practicing karate and kick boxing, comprising:

a leg protector which includes a front shin portion that covers the shin of a wearer and extends most, but not all, of the way around the leg of the wearer to form first and second opposite sides lying on opposite sides of the calf of the wearer;

said protector including a plurality of vertically spaced horizontal elastically-stretchable straps that each have an inner end attached to a first of said sides of said front portion and an outer end, a vertical strip which is joined to the outer ends of said straps, and a zipper having a pair of vertical zipper parts, one zipper part attached to said vertical strip and a second zipper part attached to the second side of the front portion, whereby to enable tight elastic gripping of the foot while enabling easy and fast putting on and taking off.

* * * * *